US005230608A

United States Patent [19]

Januska

[11] Patent Number: 5,230,608

[45] Date of Patent: Jul. 27, 1993

[54] POSITIVE FEED SYSTEM FOR WALLBOARD TAPE APPLICATORS

[76] Inventor: Charles F. Januska, 11143 Dale Rd., Whaleysville, Md. 21872

[21] Appl. No.: 834,778

[22] Filed: Feb. 13, 1992

[51] Int. Cl.[5] ..... F04B 49/02; F04B 49/08

[52] U.S. Cl. ..... 417/44; 417/53; 417/234; 417/900; 156/575; 156/578

[58] Field of Search ..... 417/900, 44, 53, 234; 156/575, 578; 366/266, 150

[56] References Cited

U.S. PATENT DOCUMENTS 3,007,837 11/1961 Goode ..... 156/575
3,707,427 12/1972 Erickson ..... 156/578
4,127,434 11/1978 Lass ..... 156/575
4,850,513 7/1989 Porter ..... 417/18
4,874,296 10/1989 Moynihan ..... 417/234
5,122,038 6/1992 Malkoski ..... 417/900

*Primary Examiner*—Richard A. Bertsch
*Assistant Examiner*—David W. Scheuermann
*Attorney, Agent, or Firm*—Lawrence J. Shurupoff

[57] ABSTRACT

Wallboard compound is fed by gravity from a reservoir to the inlet of a positive displacement pump which pressurizes the compound and feeds it to a wallboard taping applicator. The pressure of the compound fed to the applicator is controlled within predetermined limits so as to provide an even and near instantaneous flow of compound to the applicator.

7 Claims, 2 Drawing Sheets

FIG 1
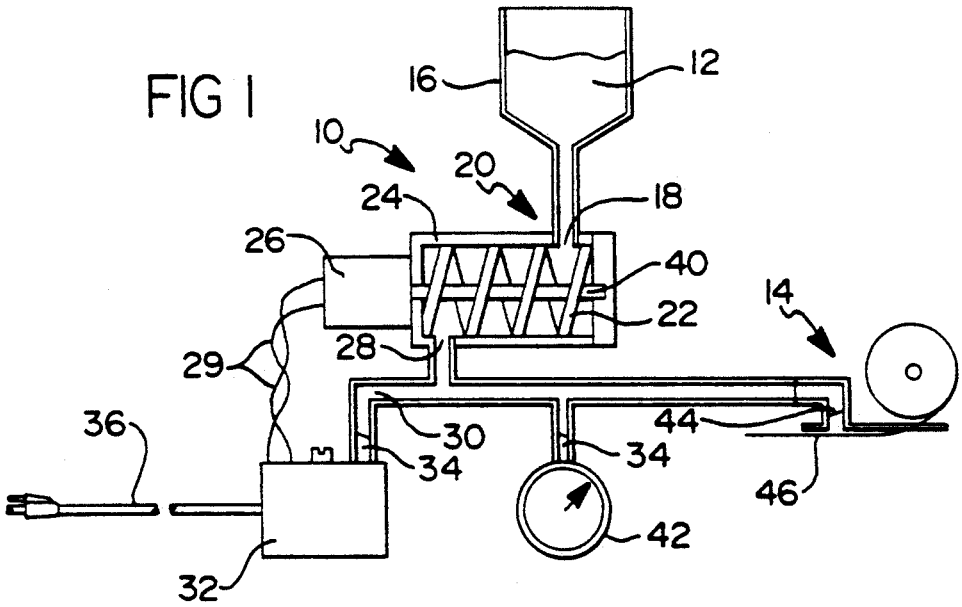
FIG 2
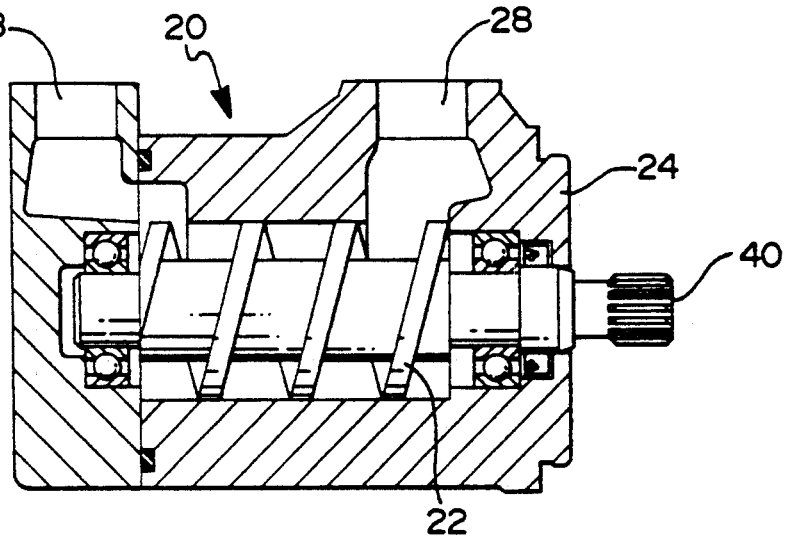
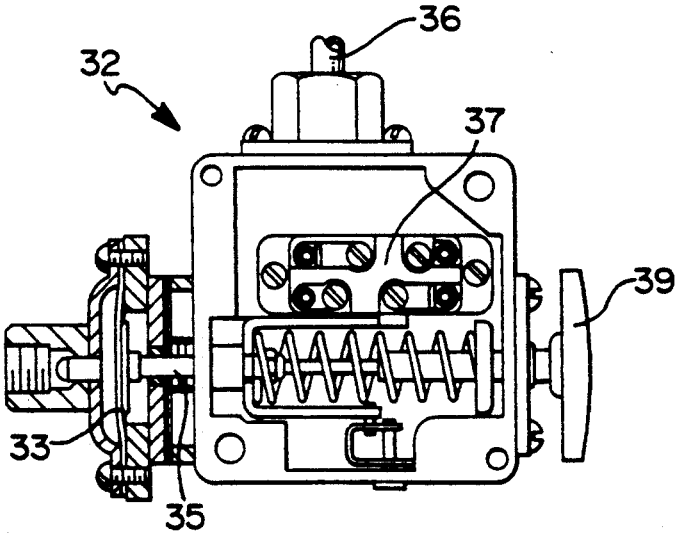
FIG 3

POSITIVE FEED SYSTEM FOR WALLBOARD TAPE APPLICATORS

BACKGROUND OF THE INVENTION

1. Field of the Invention

This invention relates generally to apparatus for dispensing wallboard compound to a wallboard tape applicator and particularly relates to a gravity-fed screw-driven positive displacement pump for delivering semi-liquid pastey wallboard compound to a wallboard tape applicator within an automatically controlled pressure range.

2. Description of Prior Developments

Pressurized systems for feeding wallboard compound to a wallboard applicator or taping head have been in use for many years. Such systems typically include a pressurized reservoir containing a viscous liquid or semi-liquid paste known as wallboard compound or "mud". The wallboard compound is generally dispensed under pressure from a lower or bottom region of the reservoir while the upper region of the reservoir is maintained at an elevated pressure to provide the required driving force. A volume of compressed air is generally used to provide this driving force.

Examples of prior compound feeding systems are disclosed in U.S. Pat. No. 3,007,837 issued to Goode, Jr., U.S. Pat. No. 3,707,427 issued to Erickson, and U.S. Pat. No. 4,080,240 issued to Dysart. Although prior pressurized compound feeding systems have been designed, few, if any, have met with full acceptance by the construction trade. A particularly bothersome problem associated with prior wallboard compound feeding systems has been their inability to maintain a relatively constant flow of compound to the applicator taping head.

More particularly, air pressurized systems require the entire volume of wallboard compound to be pressurized under a compressed volume of air. These systems generally experience a significant hesitation or time lag between the time when the compound is initially released through the applicator head and the time when the flow of compound reaches a steady state flow rate. This hesitation is attributable to the spring-like action of the compressed air and the inertial resistance to movement presented by a large volume of static wallboard compound.

The result of this hesitation is an uneven application of wallboard compound through the applicator resulting in inadequate or excess compound being applied to the wallboard being taped. More particularly, because the entire volume of compound is driven by the spring-like force of a compressed volume of air, movement of the compound through the feed and applicator system is not easily controlled or maintained within predetermined flow rates. Moreover, because of this delayed response of compound to the applicator, the operator who moves the applicator head with an uneven motion will often produce an uneven layer or thickness of compound on the wallboard. This condition often requires time-consuming touchup work and is not appreciated by operators who often work on a piece rate schedule.

Accordingly, a need exists for a wallboard compound feed system which provides a steady and closely-controlled flow rate of compound through a wallboard compound applicator. A further needs exists for a positive displacement compound feed system which experiences negligible hesitation or lag time between the initial release of compound through the applicator and the time at which the compound reaches its steady state flow rate. Another needs exists for such a system which does not require significant clean-up of the work area due to the application or leakage of excess compound from a wallboard compound applicator.

SUMMARY OF THE INVENTION

The present invention has been developed to fulfill the needs noted above and therefore has as a primary object the provision of a positive displacement feed system for wallboard compound which avoids the use of compressed air.

Another object is to provide a positive displacement feed system for wallboard compound which avoids pressurizing the wallboard compound reservoir and which pressurizes only a relatively small volume of wallboard compound.

Still another object of the invention is to automatically control the pressure of the compound fed to the applicator within relatively closely set ranges.

Yet another object of the invention is to drive a positive displacement screw pump with a commercially available hand drill which can also be used to mix the wallboard compound.

Another object of the invention is to provide a feed system for wallboard taping compound which avoids waste of compound and which requires little, if any, clean-up of the work area due to spilled, leaked, or excessive released compound.

Briefly, these objects are met by the present invention which includes a non-pressurized wallboard compound reservoir which feeds semiliquid paste-like wallboard compound under gravity to the intake port of a worm or screw-type positive displacement pump. The pump is preferably driven by an electric hand drill which is switched on and off by a simple pressure regulator. Wallboard compound exits the pump under a carefully controlled pressure range and is fed to an applicator tape head with a quick response under a closely maintained flow rate.

BRIEF DESCRIPTION OF THE DRAWINGS

Various other objects, features and attendant advantages of the present invention will be more fully appreciated from the following detailed description when considered in connection with the accompanying drawings, in which the same reference numbers designate the same or corresponding parts throughout.

FIG. 1 is a schematic view of the positive feed system arranged according to the present invention;

FIG. 2 is a cross sectional view of a positive displacement pump suitable for use with the present invention;

FIG. 3 is a cross sectional view of a pressure regulator suitable for use with the present invention.

DETAILED DESCRIPTION OF THE PREFERRED EMBODIMENT

Figure 4:
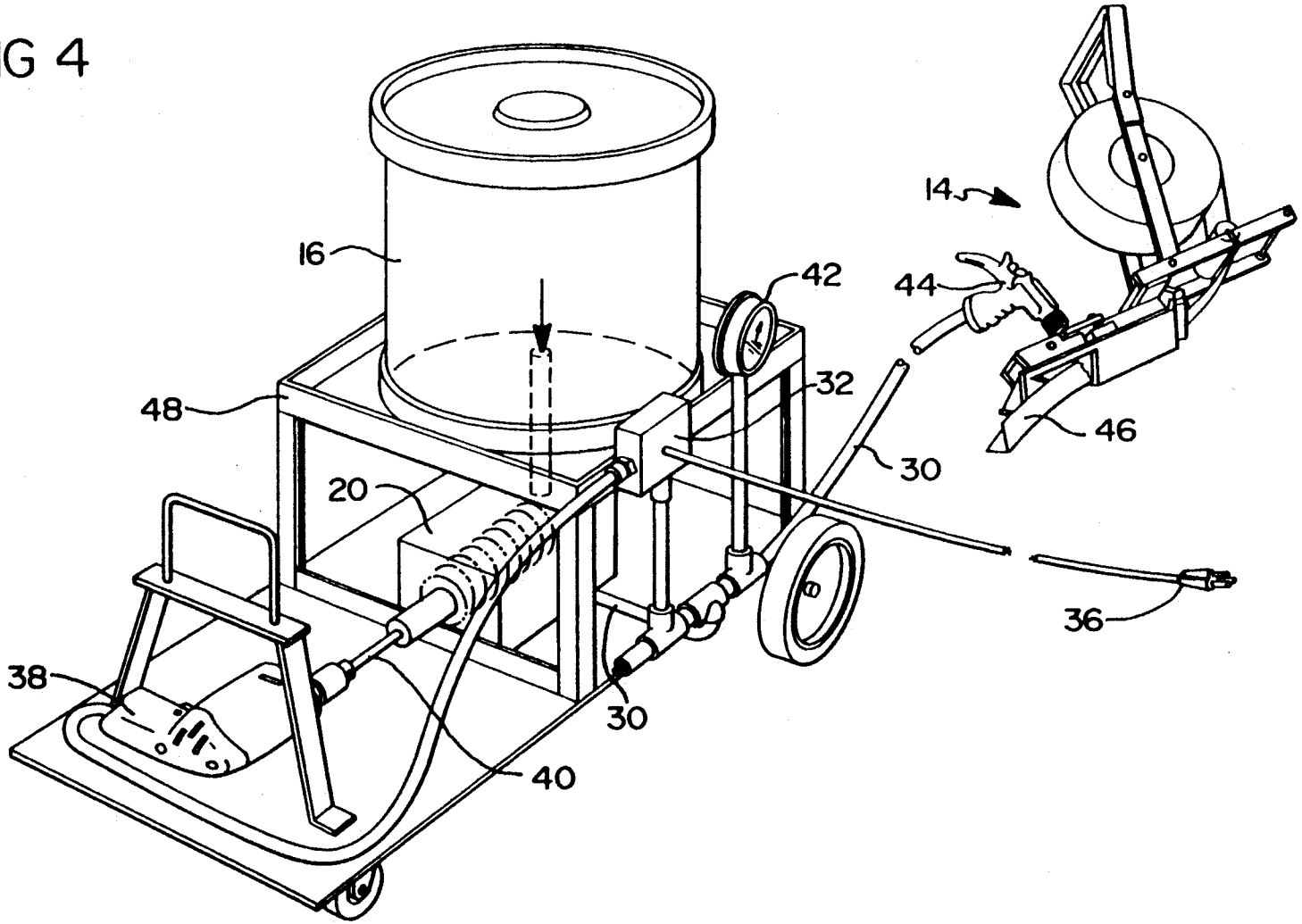
FIG. 4 if a perspective view of one practical embodiment of the system of FIG. 1.

The present invention will now be described in conjunction with the drawings, beginning with FIG. 1, which schematically depicts a positive feed system 10 for applying liquid semi-liquid or paste-like wallboard compound 12 to a wallboard applicator taping head 14. Taping head 14 is preferably of the type disclosed in U.S. Pat. No. 4,775,442, the specification of which is incorporated herein by reference.

The compound 12 is stored in a reservoir 16 which communicates with the intake port 18 of a positive displacement pump 20. Pump 20 may take the form of an auger screw or worm gear pump such as detailed in FIG. 2. A MOYNO brand pump, series 33108, available from Robins Meyers has been found to perform particularly well in this application.

Helical vane or screw 22 mounted within pump housing 24 is driven by electric motor 26 in such a direction as to positively force the compound 12 from intake port 18 through outlet or discharge port 28 and into feed line 30. The compound 12 may be supplied to pump 20 by a simple gravity feed by mounting reservoir 16 above intake port 18. Pressure within feed line 30 is controlled by a pressure regulator 32, the details of which are shown in FIG. 3.

Regulator 32 may take the form of a diaphragm-actuated electrical switch such as type AMW2 - S2 Form K available from Square D Construction. As the compound 12 enters feed line 30, it flows toward the regulator 32 and toward taping head 14. A small volume of air 34 is trapped against the diaphragm 33 of the regulator 32 and provides a variable pressure signal which causes the diaphragm to actuate a plunger 35 which opens and closes the contacts of an electrical switch 37 housed within the regulator 32. As the switch closes, it conducts line voltage from an electrical outlet through electrical cord 36 and wires 29 to electric motor 26 which drives screw 22.

Motor 26 may be any commercially available fractional horsepower motor capable of driving pump 20 at pressures in excess of 100 psi. In a specific embodiment, pump 20 may take the form of a commercially available hand drill 38 as seen in FIG. 4. Hand drill 38, which may be either a constant or variable speed drill, may be easily chucked on and off screw shaft 40 so that drill 38 may be used for drilling or for initially mixing the compound 12 using a bladed mixing attachment. This feature has proved to be most useful in practice. As seen in FIG. 4, the entire system 10 may be mounted on a portable cart 48 which may be easily rolled from one application point to another.

An optional pressure gauge 42 may be mounted in line 30 to provide a direct read-out of the pressure of the compound 12 within the feed line and applicator head 14. It has been determined that regulator 32, which includes a range adjustment knob 39 which sets an operating point on falling pressure and a differential adjustment which sets an operating point on rising pressure, should be set within an operating range of about 150 to 250 psi for most practical uses. However, in order to provide an extremely steady and even flow of viscous compound from the reservoir to the applicator head, it is better to maintain the pressure of the compound in line 30 within a range of about 180 to 200 psi.

In order to prevent the compound from dripping down the wall and onto the floor as it is being applied, the consistency of the compound should be maintained non-watery and similar to that of standard toothpaste as it comes from the tube. At this viscosity, a pump operating pressure range of 150 to 250 psi is appropriate for effectively moving the compound through 50 feet of standard commercial pressure hose from reservoir 16 to taping lead 14.

Although a lower pressure range of 80 to 120 psi could be used with a taping compound having a less viscous soupy-type of consistency, such compound tends to drip around the work area and must be subsequently removed during a time-consuming and costly cleanup operation. It is therefor preferred to drive the compound from pump 20 at pressures in excess of 100 psi and at a consistency which will not freely run when applied to wallboard yet will flow under gravity into intake port 18 of pump 20.

As an operator opens and closes valve 44 on tape head 14, compound 12 will be dispensed onto tape 46 in an even layer as described in the aforementioned U.S. Pat. No. 4,775,442. As the compound is dispensed, pressure in line 30 drops causing regulator 32 to energize motor 26 which turns screw 22 to feed additional compound into line 30 and prevent the pressure from falling below a predetermined lower limit. Once the pressure in line 30 reaches a maximum predetermined upper limit, regulator 32 switches off motor 26 until the pressure within line 30 again falls below the lower limit.

Although the pressure differential of 20 psi is acceptable, superior results can be achieved within smaller pressure ranges of 5 or 10 psi between the upper and lower operating limits. These ranges may be advantageously maintained anywhere within the 150 to 250 psi range noted above. Because the pressure and resulting flow rate of the compound are closely controlled, the entire system, including tape head 14 may be optimized to provide only the minimum amount of compound required for taping a wallboard joint. In practice, this has resulted in a near doubling of the amount of tape applied with a given amount of wallboard compound.

It can be appreciated that a relatively small volume of compound 12 is pressurized within line 30 and therefore presents less inertia to overcome when being accelerated through line 30 from a static state compared to prior designs which pressurized the entire reservoir 16. Moreover, because a smaller volume of compound is pressurized, less force is required to move it through line 30 and a very rapid response is thus provided upon actuation of valve 44 on the tape head 14.

Obviously, numerous modifications and variations of the present invention are possible in light of the above teachings. It is therefore to be understood that within the scope of the appended claims, the invention may be practiced otherwise than as specifically described herein.

What is claimed is:

1. An apparatus for feeding pressurized wallboard compound to a wallboard tape applicator, said apparatus comprising:

a reservoir for storing said compound;

a positive displacement pump having an inlet port connected to said reservoir and an outlet port for feeding said compound to said applicator under pressure;

drive means for driving said pump and pressurizing said compound; and automatic pressure regulating means connected to said drive means for automatically controlling the pressure of said compound fed to said applicator, said regulating means comprising pressure sensing means for automatically activating said drive means upon said compound reaching a first predetermined pressure after exiting said outlet port of said pump.

2. The apparatus of claim 1, wherein said positive displacement pump is a screw pump.

3. The apparatus of claim 1, wherein said regulating means further comprises means for deactivating said drive means upon said compound reaching a second predetermined pressure after exiting said outlet port of said pump.

4. The apparatus of claim 1, wherein said reservoir is disposed so as to provide a gravity-induced feed of said compound from said reservoir to said inlet port.

5. The apparatus of claim 1, wherein said drive means comprises an electric hand drill.

6. A method of automatically feeding wallboard compound from a reservoir to a wallboard tape applicator, comprising:

providing wallboard compound with a paste-like consistency;

feeding said compound from said reservoir to a positive displacement pump via gravity;

pressurizing said compound by driving said pump with a drive means;

sensing with a pressure sensing means the pressure of said compound pressurized by said pump; and automatically regulating said drive means to maintain said compound exiting said pump within a predetermined pressure range by automatically activating said drive means upon said compound reaching a predetermined pressure sensed by said sensing means.

7. An apparatus for feeding pressurized wallboard compound to a wallboard tape applicator having a valved tape head, said apparatus comprising:

a reservoir for storing said compound;

a positive displacement pump having an inlet port connected to said reservoir and an outlet port for feeding said compound to said applicator under pressure;

drive means for driving said pump and pressurizing said compound; and automatic pressure regulating means connected to said drive means for automatically controlling the pressure of said compound fed to said tape head, said regulating means comprising pressure sensing means for automatically activating said drive means upon said compound reaching a first predetermined pressure after exiting said outlet port of said pump, said regulator means further comprising electrical switch means actuated in response to said first predetermined pressure.

* * * * *